US006585320B2

(12) United States Patent
Holbrook et al.

(10) Patent No.: US 6,585,320 B2
(45) Date of Patent: Jul. 1, 2003

(54) TILT CONTROL MECHANISM FOR A TILT BACK CHAIR

(75) Inventors: Richard M. Holbrook, Altadena, CA (US); Darren M. Mark, Valencia, CA (US)

(73) Assignee: Virco Mgmt. Corporation, Torrance, CA (US)

( * ) Notice: Subject to any disclaimer, the term of this patent is extended or adjusted under 35 U.S.C. 154(b) by 0 days.

(21) Appl. No.: 09/881,987

(22) Filed: Jun. 15, 2001

(65) Prior Publication Data

US 2002/0190555 A1 Dec. 19, 2002

(51) Int. Cl.[7] ..... A47C 1/024; A47C 3/026

(52) U.S. Cl. ..... 297/300.4; 297/302.3; 297/303.3; 297/301.3; 297/440.15; 297/440.16

(58) Field of Search ..... 297/300.4, 440.15, 297/440.16, 440.1, 302.3, 301.3, 303.3

(56) References Cited

U.S. PATENT DOCUMENTS

| | | | | |
|---|---|---|---|---|
| 2,056,965 A | | 10/1936 | Herold | |
| D175,720 S | | 10/1955 | Buhk | |
| 3,072,436 A | | 1/1963 | Moore | |
| 3,107,991 A | | 10/1963 | Taussig | |
| 4,000,925 A | * | 1/1977 | Doerr et al. | 297/301.3 |
| 4,013,257 A | | 3/1977 | Paquette | |
| 4,214,726 A | | 7/1980 | Karrip et al. | |
| D260,216 S | | 8/1981 | Buhk | |
| 4,314,728 A | | 2/1982 | Faiks | 297/300.4 |
| 4,328,943 A | | 5/1982 | Eldon, III | |
| D266,722 S | | 11/1982 | Stephens | |
| 4,373,692 A | | 2/1983 | Knoblauch et al. | |
| 4,375,301 A | | 3/1983 | Pergler et al. | |
| 4,390,206 A | | 6/1983 | Faiks et al. | 297/303.3 |
| 4,438,898 A | | 3/1984 | Knoblauch et al. | 297/300.4 |
| D273,918 S | | 5/1984 | Keeler | |
| D275,060 S | | 8/1984 | Buhk | |
| 4,494,795 A | | 1/1985 | Roossien et al. | |
| 4,561,693 A | | 12/1985 | Brownlie et al. | |
| 4,570,895 A | | 2/1986 | Whitwam et al. | |
| 4,640,547 A | | 2/1987 | Fromme | |
| 4,652,050 A | | 3/1987 | Stevens | |
| D289,120 S | | 4/1987 | Chadwick et al. | |
| 4,666,121 A | | 5/1987 | Choong et al. | |
| 4,709,962 A | | 12/1987 | Steinmann | |
| 4,720,142 A | | 1/1988 | Holdredge et al. | 297/301.3 |
| D295,347 S | | 4/1988 | Chadwick et al. | |
| D296,394 S | | 6/1988 | Chadwick et al. | |
| 4,752,101 A | | 6/1988 | Yurchenco et al. | |
| D296,623 S | | 7/1988 | Chadwick et al. | |
| 4,776,633 A | | 10/1988 | Knoblock et al. | 297/300.4 |
| D299,192 S | | 1/1989 | Chadwick et al. | |
| 4,796,950 A | | 1/1989 | Mrotz, III et al. | 297/302.3 X |
| 4,818,019 A | | 4/1989 | Mrotz, III | 297/302.3 X |
| 4,865,384 A | | 9/1989 | Desanta | |
| 4,889,384 A | | 12/1989 | Sulzer | |
| 4,889,385 A | | 12/1989 | Chadwick et al. | |
| 4,892,354 A | | 1/1990 | Estkowski et al. | 297/302.3 X |
| 4,906,045 A | | 3/1990 | Hofman | 297/302.3 X |
| 4,943,115 A | | 7/1990 | Stucki | 297/300.4 |

(List continued on next page.)

*Primary Examiner*—Rodney B. White
(74) *Attorney, Agent, or Firm*—Denton L. Anderson; Sheldon & Mak

(57) ABSTRACT

An improved tilt rate control mechanism for a tilt back chair has an adjustable torsion spring, a tilt rate adjustment actuator and an actuator movement mechanism. The torsion spring has an adjustment lever for adjusting the tension on the torsion spring. The tilt rate adjustment actuator is disposed in contact with the adjustment lever such that the movement of the adjustment actuator causes movement of the adjustment lever. The adjustment actuator is moveable between (i) a first actuator position wherein the actuator is proximal to the torsion spring and the adjustment lever is in a minimum tension position, and (ii) a second actuator position wherein the actuator is distal from the torsion spring and the adjustment lever is in a maximum tension position.

50 Claims, 13 Drawing Sheets

U.S. PATENT DOCUMENTS 4,966,411 A 10/1990 Katagiri et al. ..... 297/300.4
4,979,778 A 12/1990 Shields ..... 297/300.4
4,981,326 A 1/1991 Heidmann
D315,998 S 4/1991 Edwards
5,026,117 A 6/1991 Faiks et al.
5,029,940 A * 7/1991 Golynsky et al. ..... 297/300.4
5,033,791 A 7/1991 Locher
5,042,876 A 8/1991 Faiks
5,090,770 A 2/1992 Heinrichs et al.
5,106,157 A 4/1992 Nagelkirk et al.
5,114,211 A 5/1992 Desanta
D326,577 S 6/1992 Edwards
5,160,184 A 11/1992 Faiks et al.
5,192,114 A 3/1993 Hollington et al.
5,203,853 A 4/1993 Caruso ..... 297/302.3 X
5,207,479 A 5/1993 Wickman et al.
5,224,758 A 7/1993 Takamatsu et al.
5,238,294 A 8/1993 Ishi et al.
5,318,345 A 6/1994 Olson
5,320,410 A 6/1994 Faiks et al.
5,324,096 A 6/1994 Schultz
5,333,368 A * 8/1994 Kriener et al. ..... 297/303.3 X
5,354,120 A 10/1994 Volkle
5,366,274 A 11/1994 Roericht et al.
5,370,445 A 12/1994 Golynsky ..... 297/302.34 X
5,382,077 A 1/1995 Stumpf et al.
5,388,889 A * 2/1995 Golynsky ..... 297/302.3
5,405,189 A 4/1995 Stumpf
5,567,012 A 10/1996 Knoblock ..... 297/300.4
5,577,807 A 11/1996 Hodge et al.
5,630,647 A 5/1997 Heidmann et al. ..... 297/303.3
5,683,139 A 11/1997 Golynsky et al. ..... 297/300.4
5,725,277 A 3/1998 Knoblock ..... 297/300.4
D393,755 S 4/1998 Nemeth, Jr.
5,765,914 A 6/1998 Britain et al. ..... 297/300.4
5,772,282 A 6/1998 Stumpf et al. ..... 297/302.3
5,810,439 A 9/1998 Roslund, Jr. ..... 297/300.4
5,909,924 A 6/1999 Roslund, Jr. ..... 297/301.3
5,915,788 A 6/1999 Schneider
D413,214 S 8/1999 Chu
5,944,387 A 8/1999 Stumpf
5,951,109 A 9/1999 Roslund, Jr. et al.
5,957,534 A 9/1999 Wilkerson et al.
5,975,634 A * 11/1999 Knoblock et al. ..... 297/300.4
5,979,984 A 11/1999 DeKraker et al.
5,997,087 A 12/1999 Stumpf
6,003,943 A 12/1999 Schneider ..... 297/301.3
6,015,187 A 1/2000 Roslund, Jr. et al. .... 297/300.4
6,027,169 A 2/2000 Roslund, Jr.
6,059,368 A 5/2000 Stumpf et al.
6,086,153 A * 7/2000 Heidmann et al. ... 297/300.4 X
6,102,477 A 8/2000 Kurtz
6,125,521 A 10/2000 Stumpf et al.
6,135,556 A 10/2000 Chu et al.
D437,702 S 2/2001 Koepke et al.
6,250,715 B1 6/2001 Caruso et al.
6,273,506 B1 * 8/2001 Niergarth et al. ..... 297/300.4
6,386,634 B1 * 5/2002 Stumpf et al. ..... 297/300.4

* cited by examiner

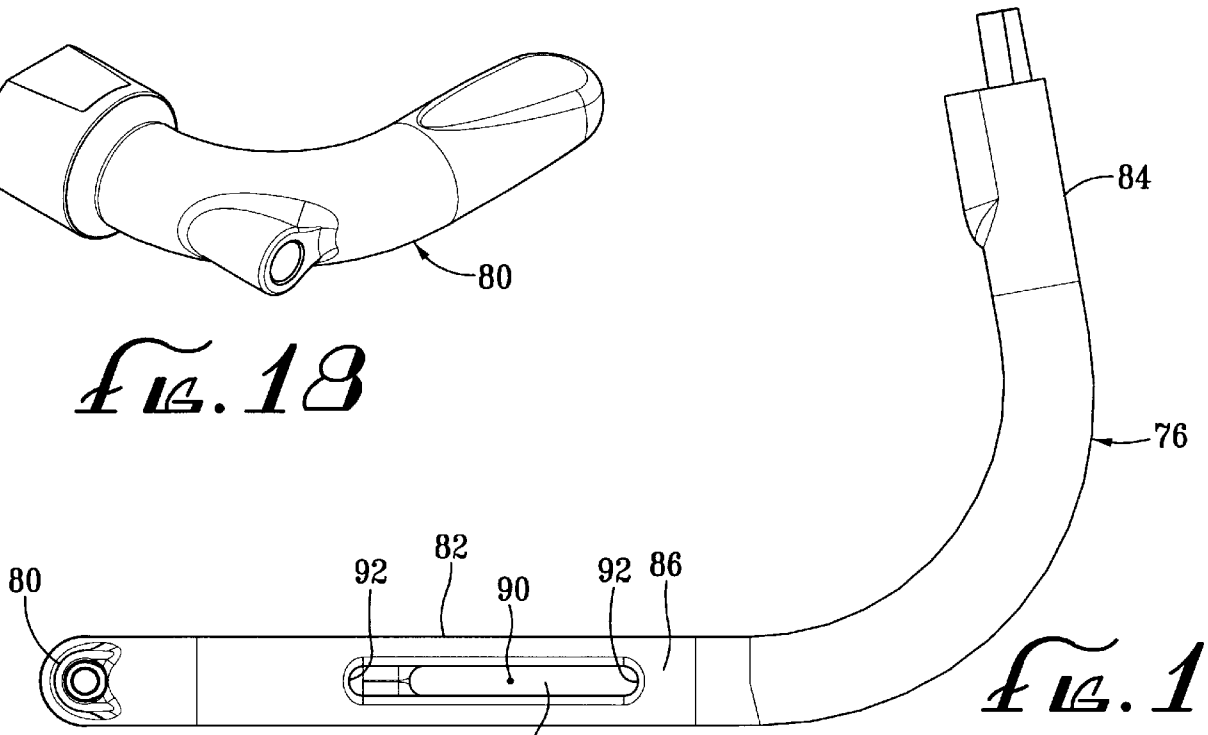
Fig. 16
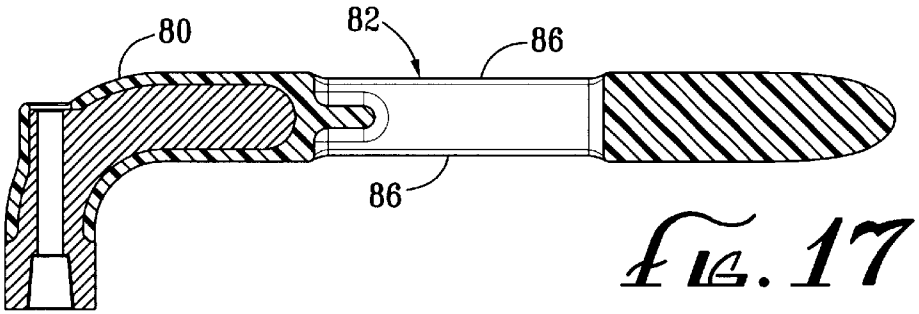
Fig. 17
Fig. 18

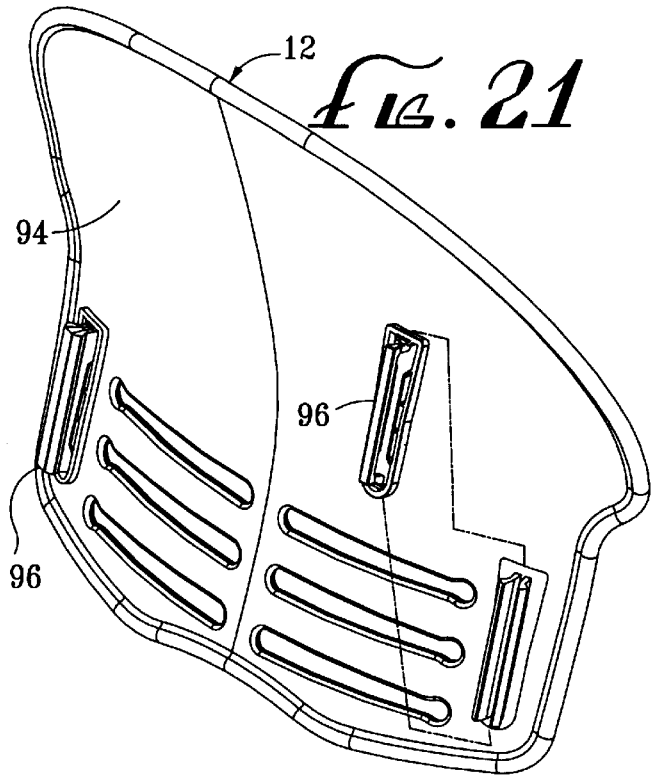
FIG. 21
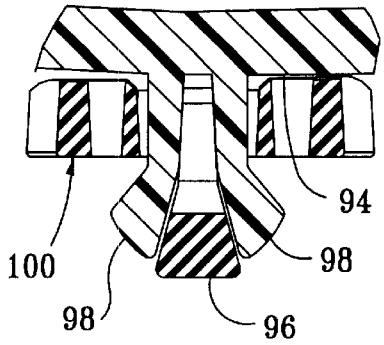
FIG. 22
FIG. 24A
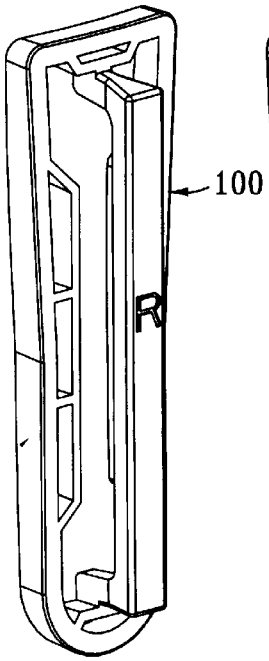
FIG. 24B
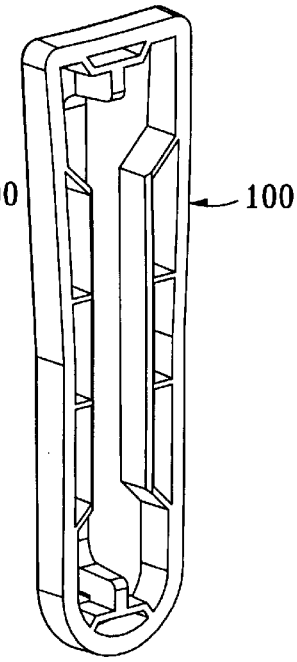
FIG. 23
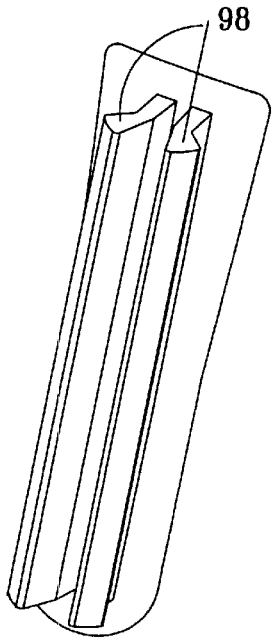

TILT CONTROL MECHANISM FOR A TILT BACK CHAIR

FIELD OF THE INVENTION

This invention relates generally to chairs and, more specifically, to tilt back chairs and mechanisms for controlling the tilting of the back of a tilt back chair.

BACKGROUND OF THE INVENTION

Tilt back chairs, wherein the back of the chair—or the back and the seat of the chair—tilt rearwardly with respect to the base of the chair, have become very popular. Tilt back chairs are especially popular for use as office chairs and conference room chairs.

Traditionally, the resistance to the tilting of the back of a tilt back chair is controlled by one or more coil springs. Recently, tilt back chairs have been designed using an elastomeric spring instead of coil springs. The use of elastomeric springs is believed by many to provide a smoother and more easily controlled tilt to the back of a tilt back chair. One such tilt back chair using an elastomeric spring is disclosed in U.S. Pat. No. 5,772,282, the entirety of which is incorporated herein by this reference.

Unfortunately, the use of an elastomeric spring in the tilt back chair disclosed in U.S. Pat. No. 5,772,282 is not wholly satisfactory. One problem with such a chair has to do with manually increasing the pretension on the elastomeric spring. In the chair taught in U.S. Pat. No. 5,772,282, manually increasing the pretension on the elastomeric spring becomes increasingly difficult as the pretension on the spring increases.

Accordingly, there is a need for a tilt back chair using an elastomeric spring which avoids the aforementioned problems in the prior art.

SUMMARY

The invention satisfies this need. The invention is a tilt rate adjustment mechanism for use in a tilt back chair having a base, a seat and a back. The tilt rate adjustment mechanism is adapted to adjust the amount of force required to tilt the back of the chair, or the back and the seat of the chair, relative to the base of the chair.

In the invention, the tilt rate adjustment mechanism comprises an adjustable torsion spring, a tilt rate adjustment actuator and an actuator movement mechanism. The torsion spring is mounted on a torsion spring shaft. The torsion spring is operatively attached to the back of the tilt back chair such that the rearward tilting of the back is resisted by the tension of the torsion spring. The torsion spring has an adjustment lever for adjusting the tension on the torsion spring. The adjustment lever has a proximal end, a central portion and a distal end. The proximal end of the adjustment lever is rotatable about the torsion spring shaft between a minimum tension position, wherein the torsion spring resists the tilting of the chair back with minimum tension, and a maximum tension position, wherein the tension spring resists the tilting of the chair back with maximum tension.

The tilt rate adjustment actuator is disposed in contact with the adjustment lever such that the movement of the adjustment actuator causes movement of the adjustment lever. The adjustment actuator is moveable between (i) a first actuator position wherein the actuator is proximal to the torsion spring and the adjustment lever is in the minimum tension position, and (ii) a second actuator position wherein the actuator is distal from the torsion spring and the adjustment lever is in the maximum tension position.

Finally, the actuator movement mechanism is adapted to alternatively move the actuator back and forth between the first actuator position and the second actuator position.

In a typical, but not required, embodiment, the adjustable torsion spring is an elastomeric torsion spring.

In one embodiment of the invention, the adjustable torsion spring is operably attached to both the back and the seat of the tilt back chair such that the rearward tilting of both the back and the seat of the chair is resisted by the tension of the torsion spring.

DRAWINGS

These features, aspects and advantages of the present invention will become better understood with regard to the following description, appended claims and accompanying figures where:

FIG. 16 is a side view of a connection member useable in the invention;

FIG. 17 is a cross-sectional view of the connection member illustrated in FIG. 16;

FIG. 18 is an isometric view of the proximal end of the connection member illustrated in FIG. 16;

FIG. 21 is an isometric view of the back of the chair illustrated in FIG. 20;

FIG. 22 is a cross-sectional detail view of an attachment ridge useable to attach the back of a chair to connection members such as illustrated in FIG. 20;

FIG. 23 is an isometric view of a pair of spaced apart elongate ridge moieties useable in the invention;

FIG. 24*a* is a forward side of a stiffener member useable in the invention;

FIG. 24*b* is the rearward side of the stiffener member illustrated in FIG. 24*a;*

Figure 2:
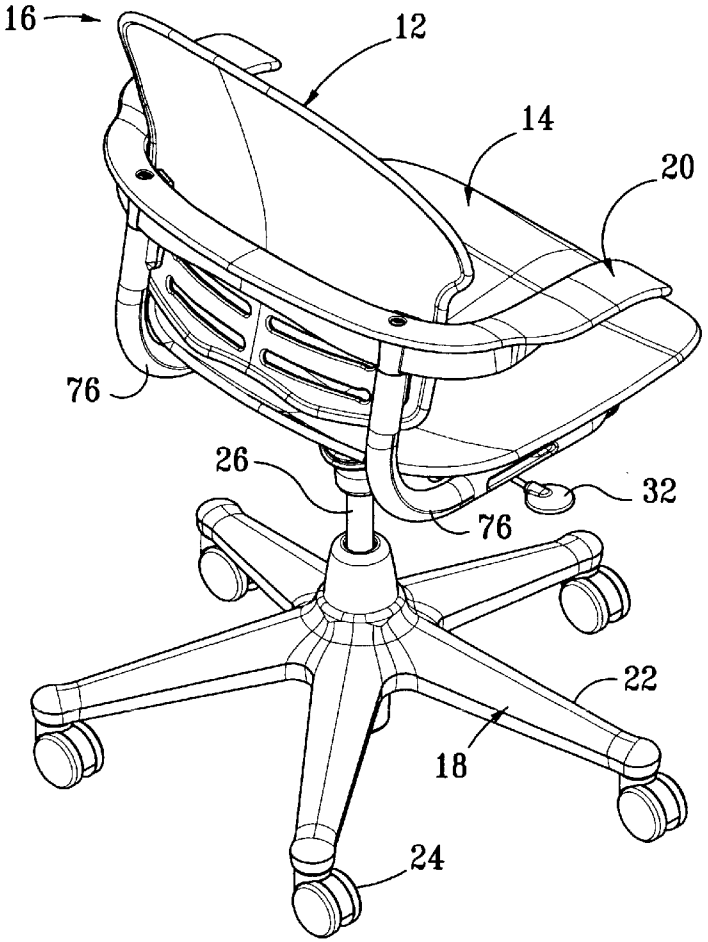
FIG. 2 is a second isometric view of the chair illustrated in FIG. 1.
Figure 1:
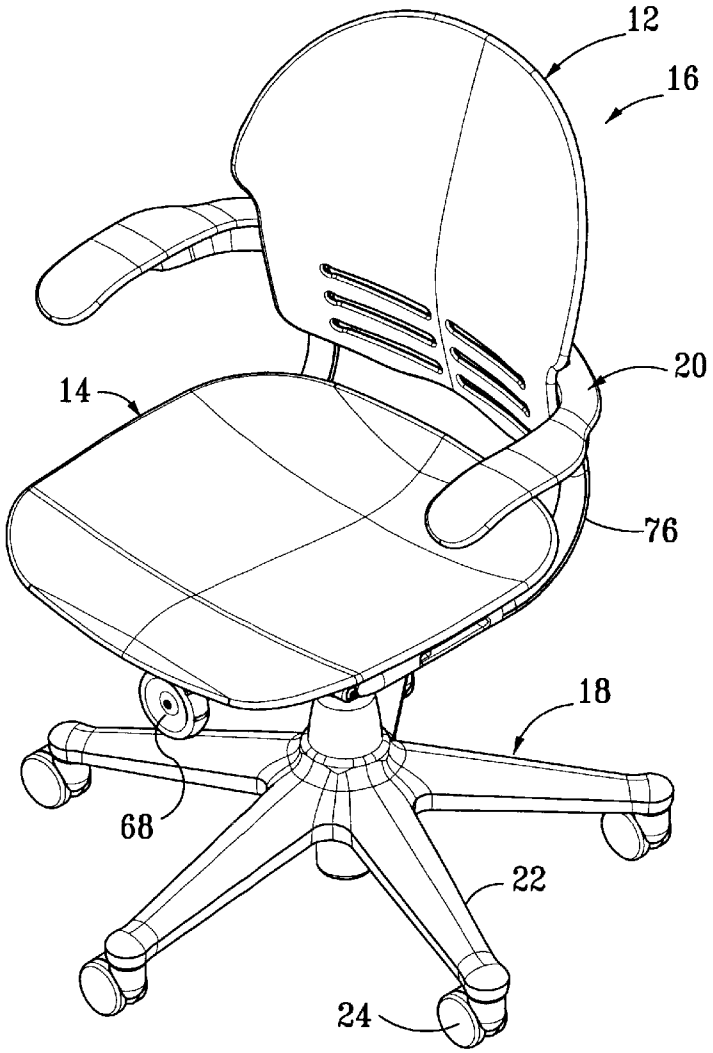
FIG. 1 is an isometric view of a chair having features of the invention.
Figure 3:
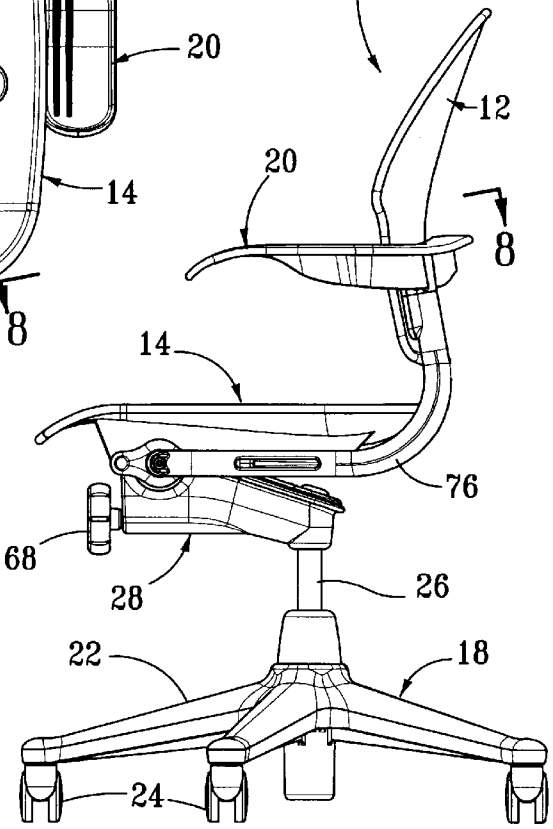
FIG. 3 is a side view of the chair illustrated in FIG. 1.
Figure 5:
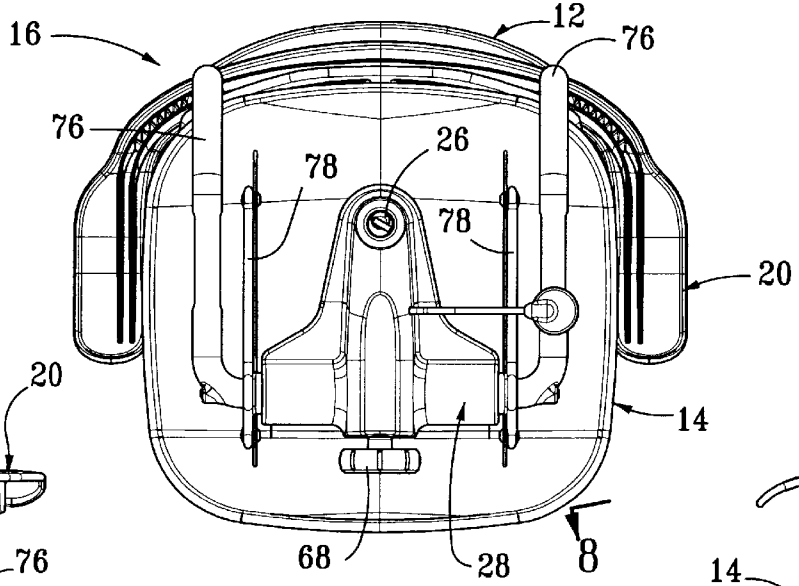
FIG. 5 is a bottom view of the chair illustrated in FIG. 4, taken along line 5—5.
Figure 4:
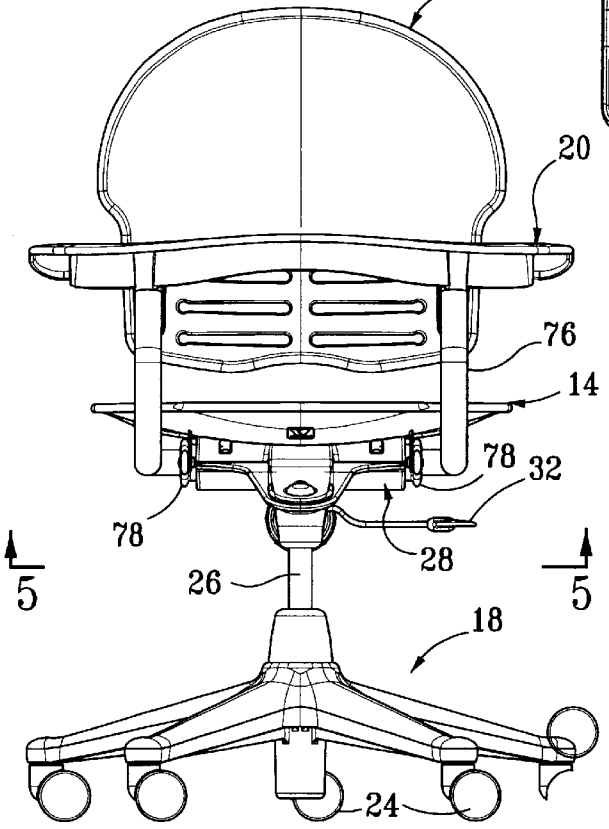
FIG. 4 is a rear view of the chair illustrated in FIG. 1.
Figure 7:
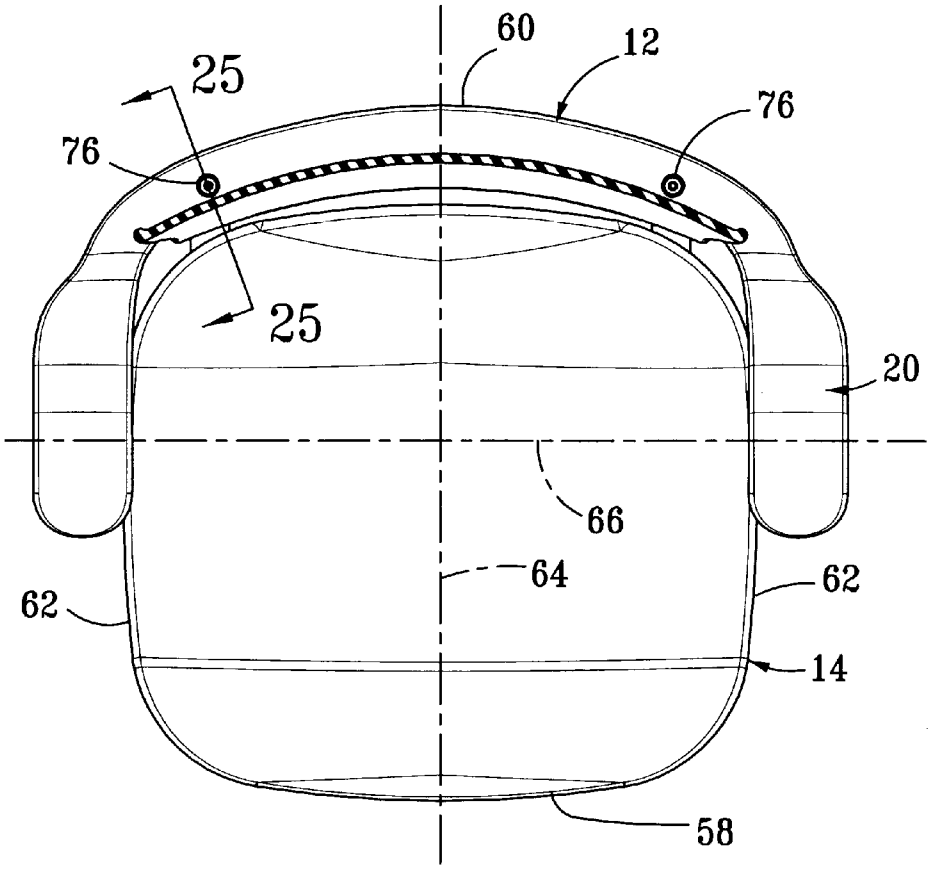
FIG. 7 is a top view of the chair illustrated in FIG. 6.
Figure 6:
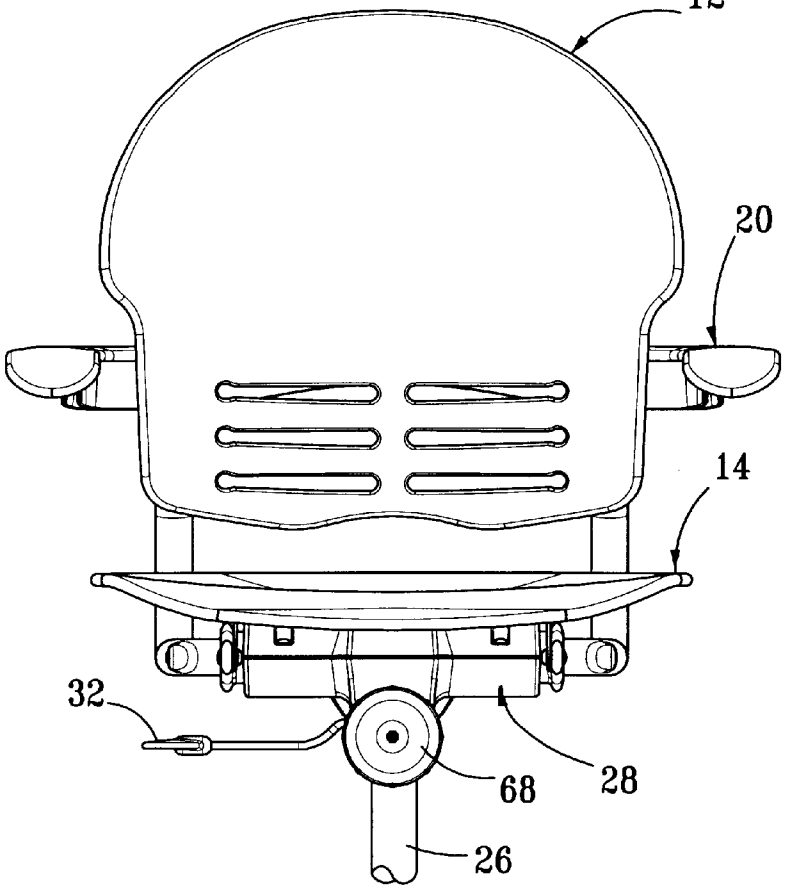
FIG. 6 is a front view of the upper portion of the chair illustrated in FIG. 1.
Figure 8:
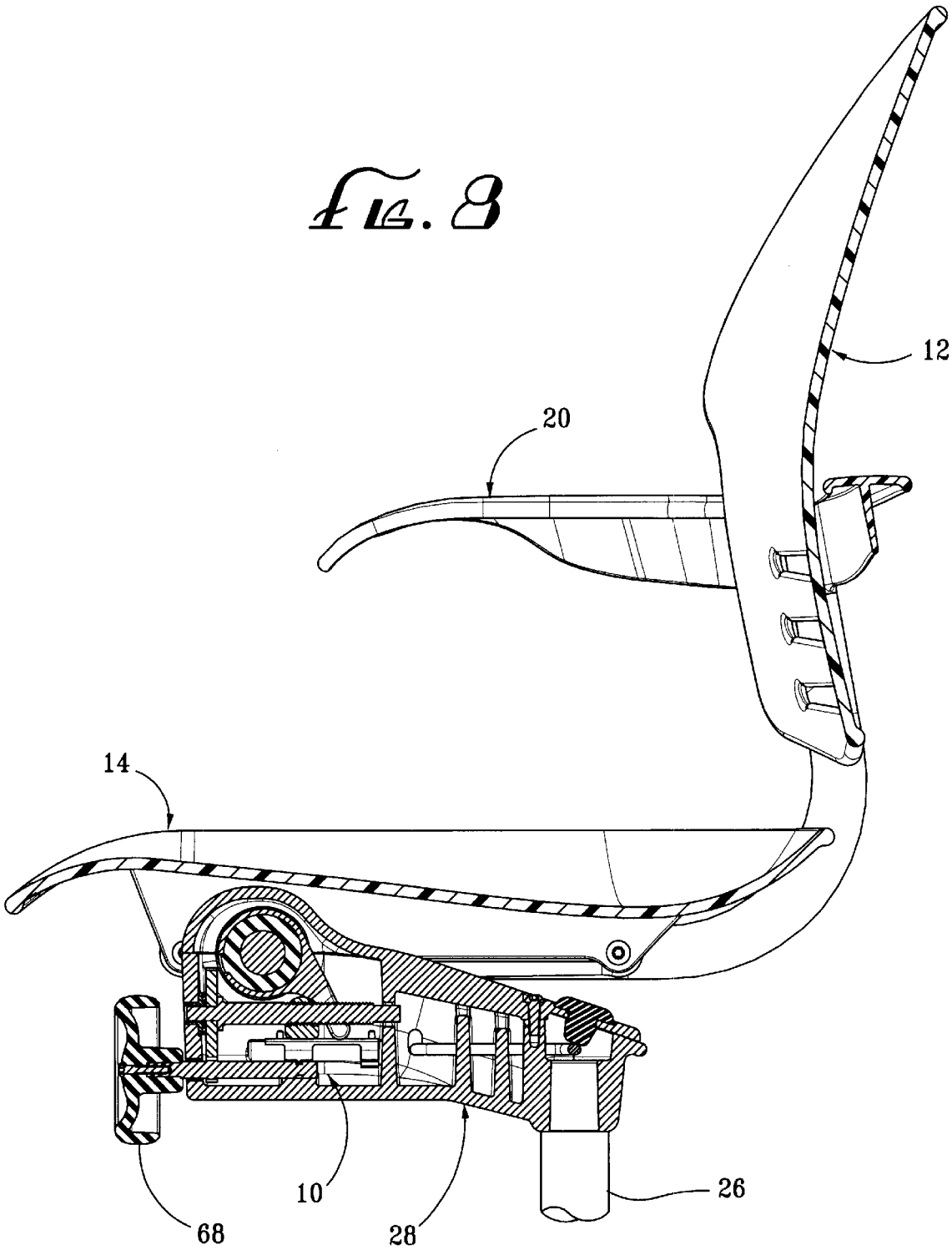
FIG. 8 is a cross-sectional side view of the upper portion of the chair illustrated in FIG. 3, taken along line 8—8.
Figures 9, 29, 30:
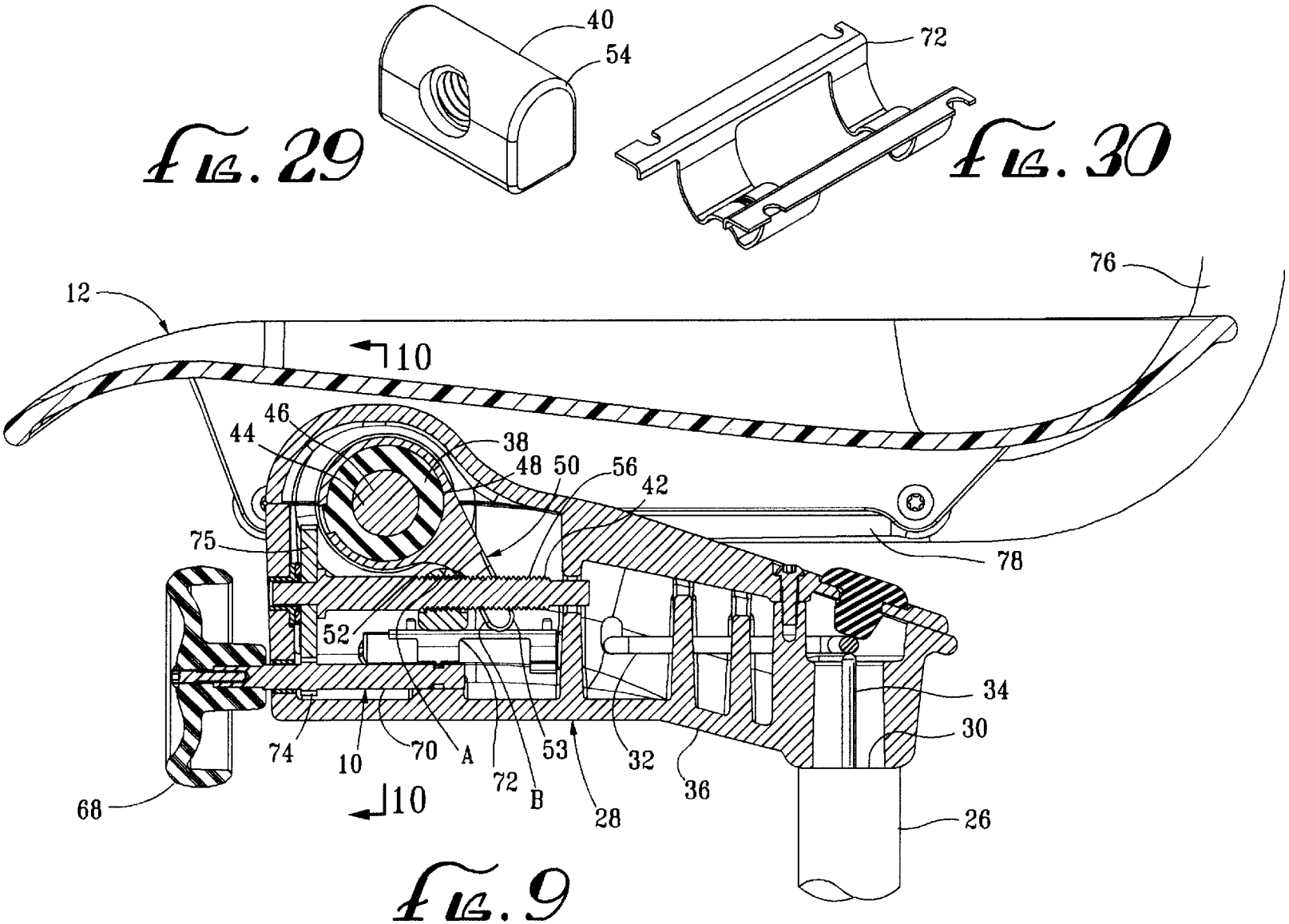
FIG. 9 is a detail view of the chair seat illustrated in FIG. 8.
Figure 10:
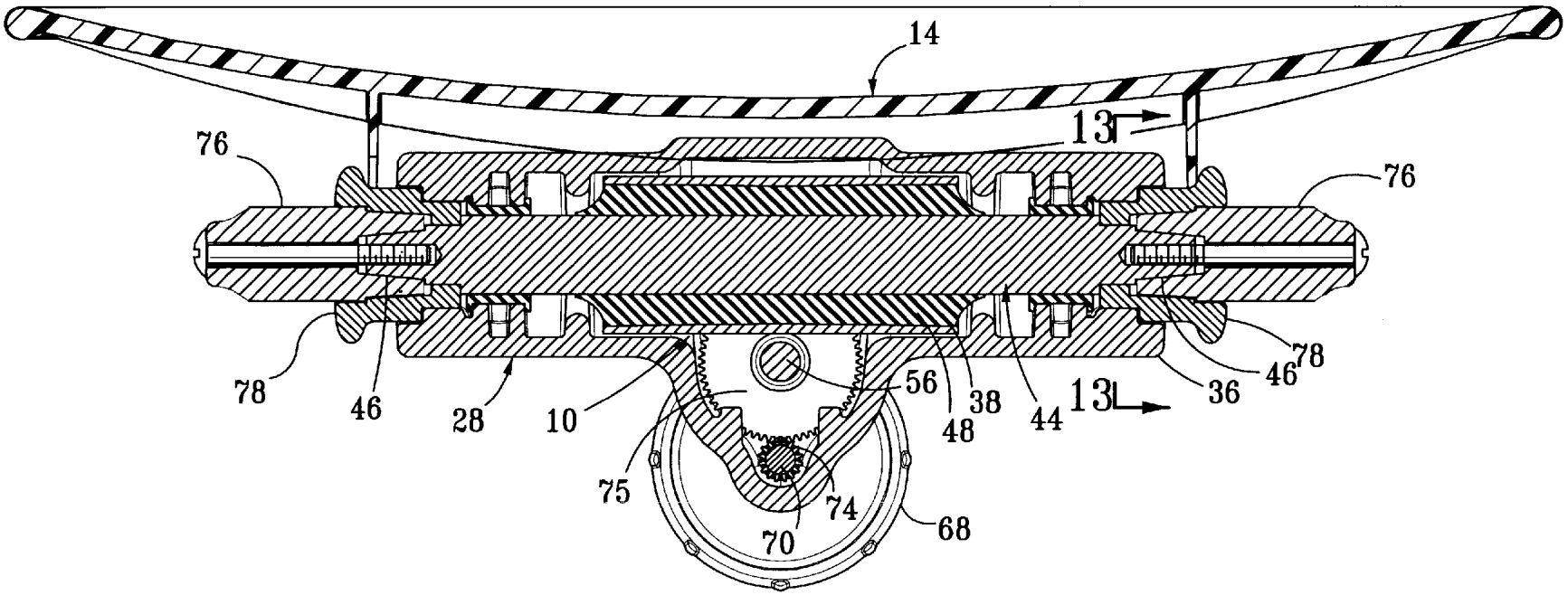
FIG. 10 is a cross-sectional view of the forward portion of the seat illustrated in FIG. 9, taken along line 10—10.
Figure 26:
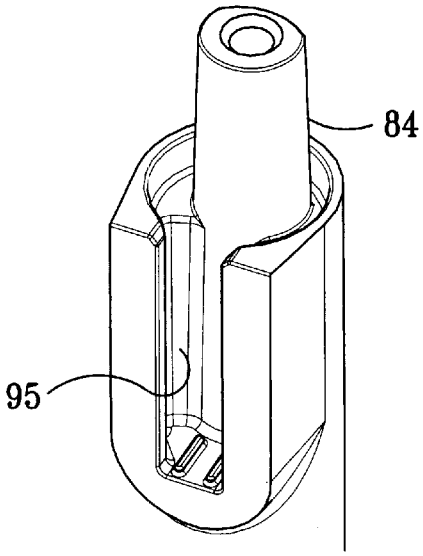
Figure 25:
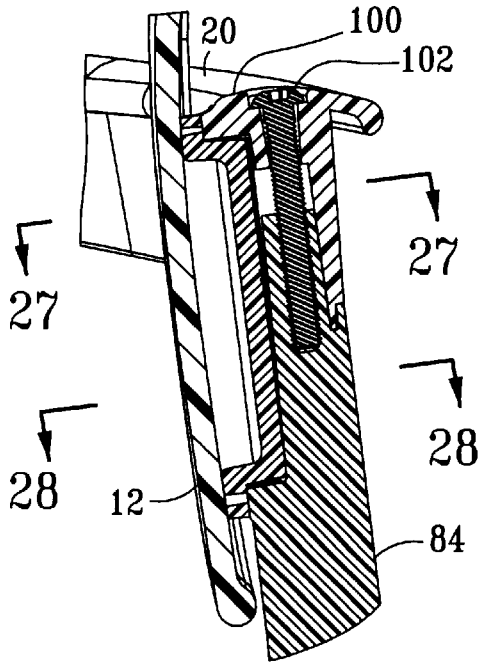
Figure 27:
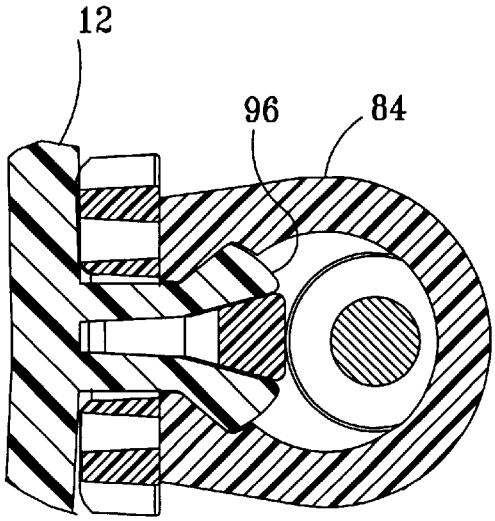
Figure 28:
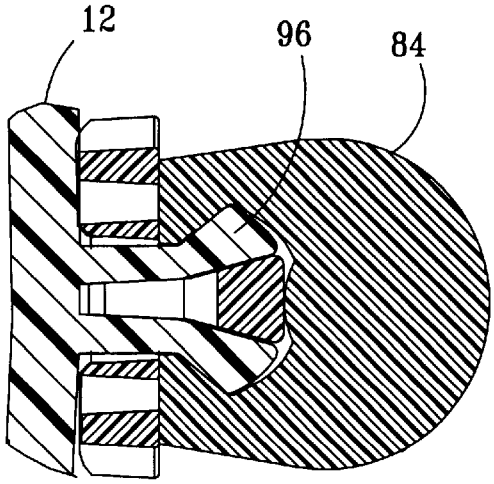

FIG. 25 is a cross-sectional detail view of the assembly of a chair back to connection members of the tilt back chair illustrated in FIG. 7, taken along line 25—25;

FIG. 26 is a detail view of the upper end of a connection member useable in the invention;

FIG. 27 is a cross-sectional view of the assembly illustrated in FIG. 25, taken along line 27—27;

FIG. 28 is a cross-sectional view of the assembly illustrated in FIG. 25, taken along line 28—28;

FIG. 29 is an isometric view of an adjustment nut useable in the invention; and FIG. 30 is an isometric view of a hand knob shaft carriage useable in the invention.

DETAILED DESCRIPTION

The following discussion describes in detail one embodiment of the invention and several variations of that embodiment. This discussion should not be construed, however, as limiting the invention to those particular embodiments. Practitioners skilled in the art will recognize numerous other embodiments as well.

In one embodiment, the invention is a tilt rate adjustment mechanism 10 for adjusting the amount of tension required to rearwardly tilt the back 12, or rearwardly tilt the back 12 and downwardly tilt the seat 14, of a tilt back chair 16 with respect to the base 18 of the chair 16. In another embodiment, the invention is a tilt back chair 16 having such a tilt rate adjustment mechanism 10.

A typical tilt back chair 16 having features of the invention is illustrated in FIGS. 1–7. The chair 16 has a base 18, a seat 14 and a back 12. In the embodiment illustrated in the drawings, the chair 16 also has arm rests 20.

The base 18 of the chair 16 provides a stable platform upon which is disposed the seat 14 and the back 12. In the embodiment illustrated in the drawings, the base 18 comprises five radially spaced-apart legs 22, each disposed upon a caster 24. In a typical embodiment, the legs 22 can be made from a nylon.

In the embodiment illustrated in the drawings, the base 18 further comprises a vertically disposed base post 26 which supports a tilt assembly 28. Disposed within the base post 26 is a gas spring 30 adapted in a traditional manner known to those skilled in the art to allow for the height of the tilt assembly 28 to be adjusted up and down. The vertical adjustment of the tilt assembly 28 is accomplished by the use of a height adjustment lever 32 which is operably attached to an adjustment button 34 on the upper end of the gas spring 30.

The seat 14 can be made from a wide variety of seating materials. In the embodiment illustrated in the drawings, the seat 14 is molded from a plastic material. In one embodiment, the seat 14 is molded from a plastic material and has a silicone gel insert disposed near the center of the upper portion of the seat. Such a molded silicone-containing seat is commercially sold by Royal Medica S. r. l. of S. Pietro in Gu', Italy. Other types of seats, such as traditional padded seats, can also be used in the chair 16.

The back 12 of the chair 16 illustrated in the drawings can be a one-piece molded back 12, molded from a plastic or other suitable material. Other types of backs, such as traditional padded backs and wooden backs, can also be used in the chair 16.

FIGS. 8–10 and 19 illustrate the tilt assembly 28. The tilt assembly 28 comprises the tilt rate adjustment mechanism 10 disposed within a tilt assembly housing 36. The tilt rate adjustment mechanism 10 comprises an adjustable torsion spring 38, a tilt rate adjustment actuator 40 and an actuator movement mechanism 42.

Figures 11, 12:
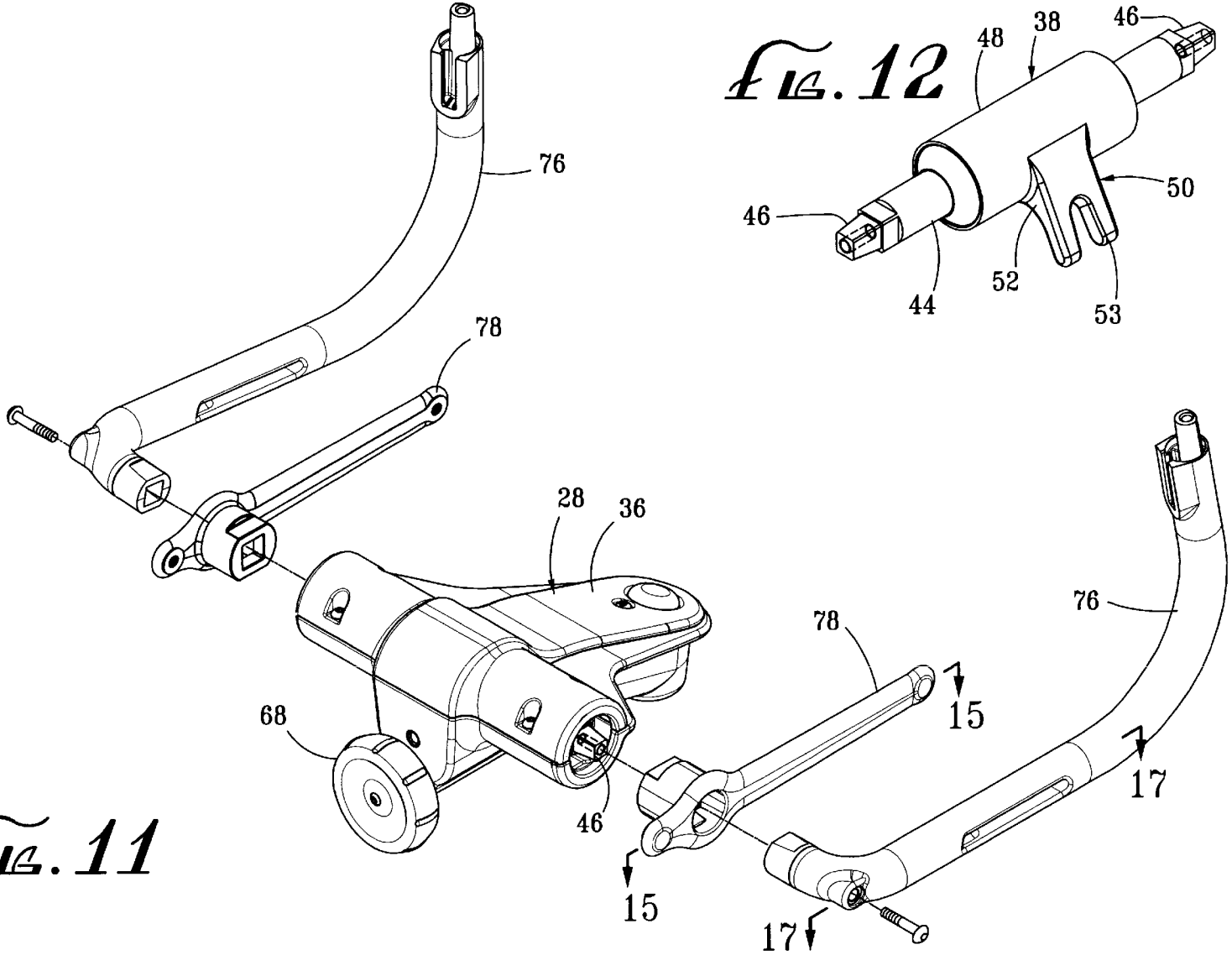
FIG. 11 is a detail view illustrated equipment useable in the invention to attach a seat and back to a chair base.
FIG. 12 is an isometric view of an elastomeric torsion spring useable in the invention.
Figure 14:
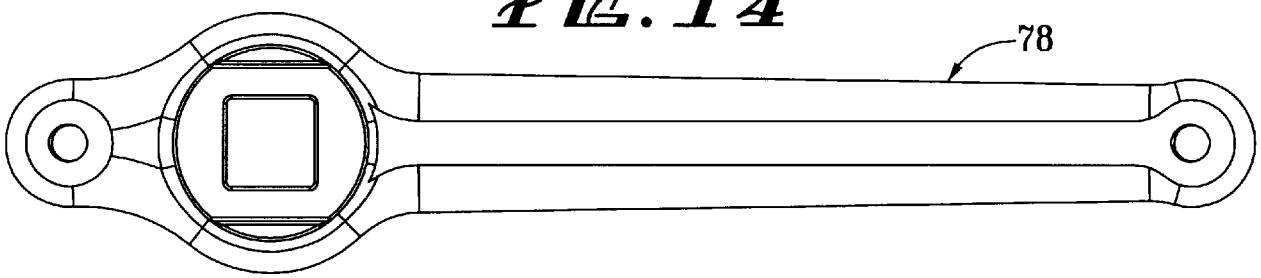
FIG. 14 is a side view of the seat attachment member illustrated in FIG. 13.
Figure 13:
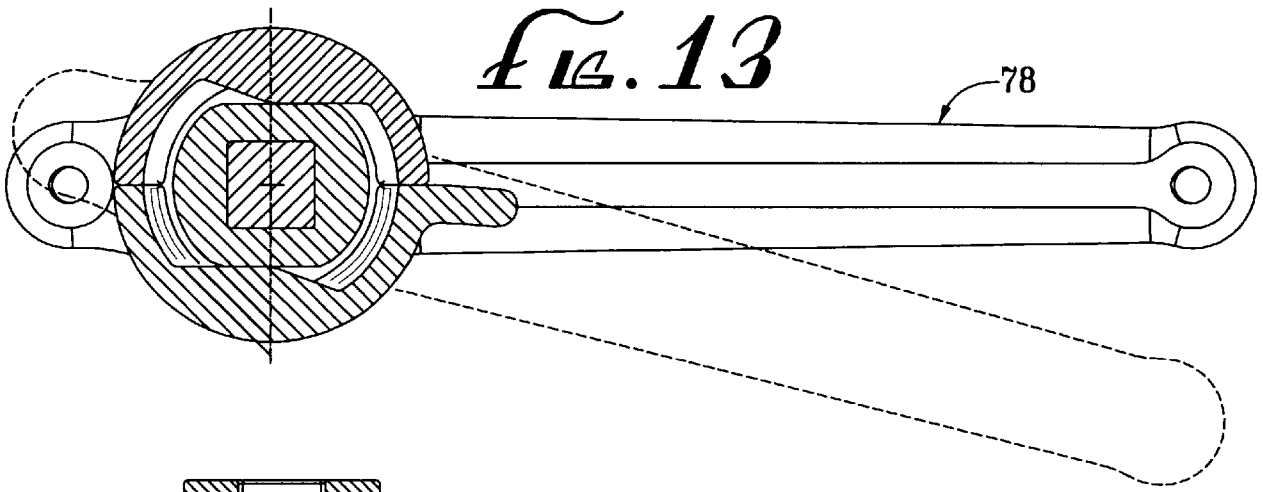
FIG. 13 is a side view in partial cross-section of a seat attachment member useable in the invention.
Figure 15:
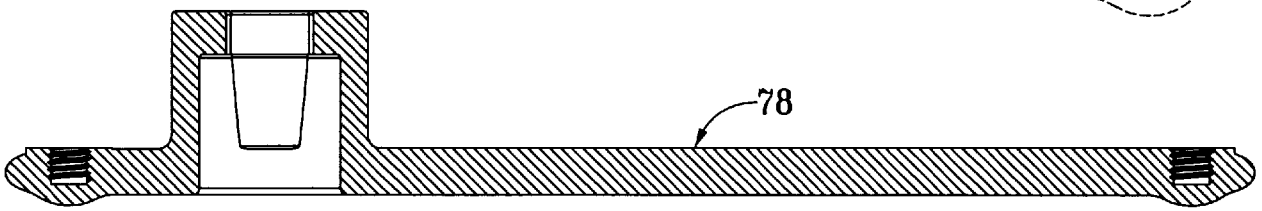
FIG. 15 is a cross-sectional view of the seat attachment member illustrated in FIG. 13.
Figure 19:
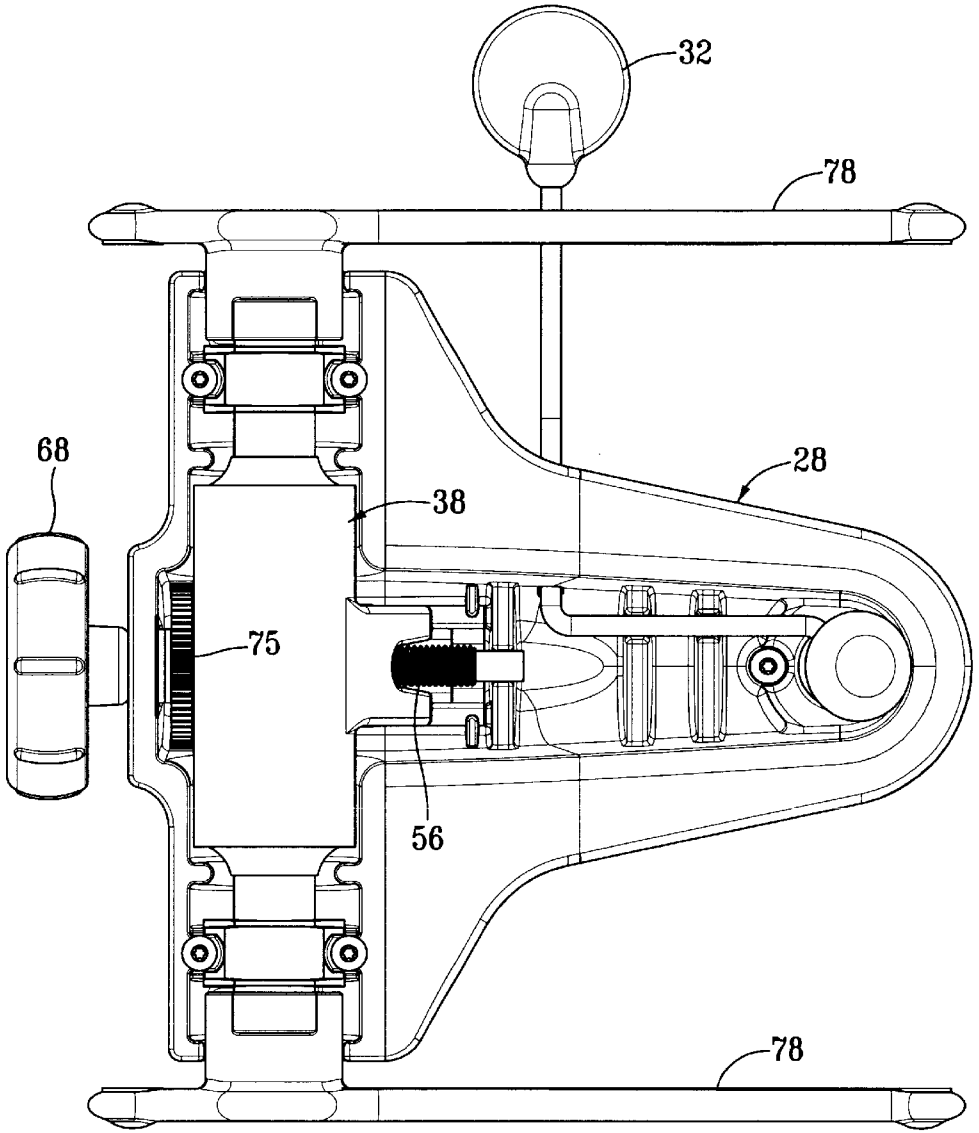
FIG. 19 is a top view of a tilt assembly useable in the invention.
Figure 20:
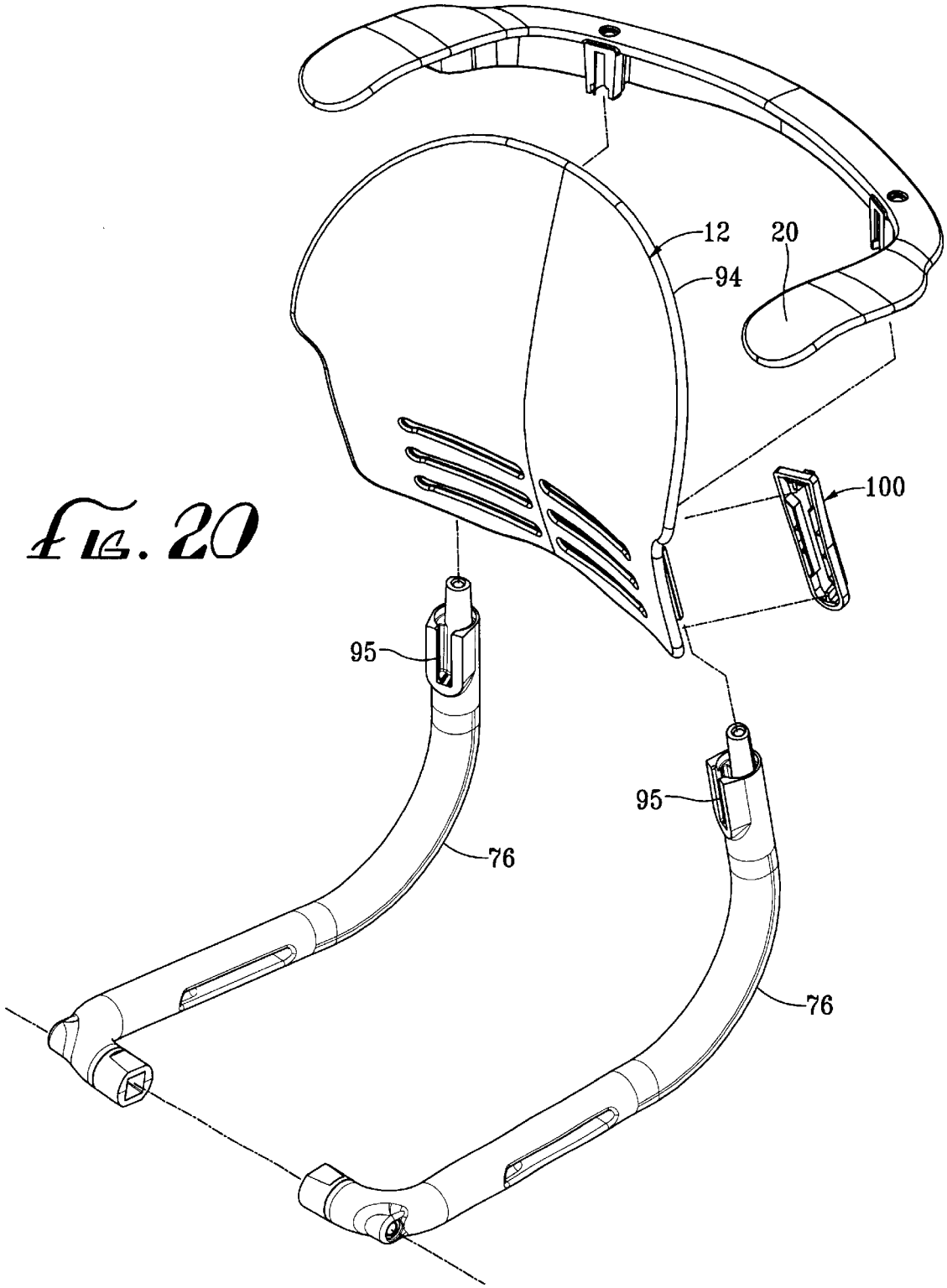
FIG. 20 is an exploded isometric view illustrating the assembly of the back of a chair to connection members in a chair having features of the invention.

The torsion spring 38 (best seen in FIG. 12) is mounted on a torsion spring shaft 44 having opposed ends 46. The torsion spring shaft 44 can be made from a steel or cast aluminum. In the embodiment illustrated in the drawings, the torsion spring 38 is an elastomeric torsion spring known to those skilled in the art as comprising an elastomeric cylinder 48 bonded to an axially disposed torsion spring shaft 44.

The torsion spring 38 has an adjustment lever 50 for adjusting the tension on the torsion spring 38. The adjustment lever 50 has a proximal end 52 and a distal end 53. The adjustment lever 50 is rotatable about the torsion spring 38 between a minimum tension position and a maximum tension position. As will be described further below, when the adjustment lever 50 is disposed in the minimum tension position, the torsion spring resists the rearwardly tilting of the chair back 12 and the downwardly tilting of the chair seat 14 with minimum tension. Conversely, when the adjustment lever 50 is disposed in the maximum tension position, the torsion spring 38 resists the rearwardly tilting of the chair back 12 and the downwardly tilting of the chair seat 14 with markedly increased tension (hereinafter referred to as "maximum tension").

The tilt rate adjustment actuator 40 is disposed in contact with the adjustment lever 50 such that the movement of the adjustment actuator 40 causes movement of the adjustment lever 50. The adjustment actuator 40 is disposed between (i) a first actuator position wherein the actuator 40 contacts the lever 50 at a first location A along the lever 50 which is distal to the distal end 53 of the lever 50 and the adjustment lever 50 is in the minimum tension position and (ii) a second actuator position wherein the actuator 40 contacts the lever 50 at a second location B along the lever 50 which is proximal to the distal end 53 of the lever 50 and the adjustment lever 50 is in the maximum tension position.

In the embodiment illustrated in the drawings, the tilt rate adjustment actuator 40 comprises an internally threaded tension adjustment nut 54 (best understood from in FIG. 29).

The actuator movement mechanism 42 is adapted to alternatively move the tilt rate adjustment actuator 40 back and forth between the first actuator position and the second actuator position. In the embodiment illustrated in the drawings, the actuator movement mechanism 42 comprises a rotatable threaded shaft 56 having external threads which match the internal threads of the adjustment nut 54. The adjustment nut 54 is mounted on the threaded shaft 56 such that the rotation of the threaded shaft 56 causes the lateral movement of the adjustment nut 54 along the threaded shaft 56.

The chair 16 has a forward portion 58, a rearward portion 60, a pair of opposed side portions 62 and a longitudinal axis 64 disposed horizontally between the center of the forward portion 58 and the center of the rearward portion 60. The chair 16 further has a transverse axis 66 disposed horizontally between the centers of the opposed side portions 62. In the embodiment illustrated in the drawings, the torsion spring shaft 44 is disposed substantially parallel to the transverse axis 66 of the chair 16 and the rotatable threaded shaft 56 is disposed substantially parallel with the longitudinal axis 64 of the chair 16. Thus, the movement of the adjustment nut 54 in a direction from the forward portion 58 of the chair 16 to the rearward portion 60 of the chair 16 causes the adjustment lever 50 of the torsion spring 38 to rotate upwardly.

By the aforedescribed unique design, the tilt rate adjustment mechanism 10 markedly minimizes the problem in the prior art regarding the fact that increasing the tension on the torsion spring 38 becomes increasingly difficult as the tension on the torsion spring 38 is increased. By the unique design of the invention, the increasing of the tension on the torsion spring 38 is made markedly easier than in prior art designs because the increasing of the tension on the torsion spring 38 is accomplished by contacting the tilt rate adjustment actuator 40 against the adjustment lever 50 at an ever increasing distance from the torsion spring 38. This provides ever increasing mechanical advantage towards the rotation of the adjustment lever 50 towards the maximum tension position.

In the embodiment illustrated in the drawings, the tension on the torsion spring 38 can be manually adjusted by rotating a hand knob 68 disposed beneath the seat 14. The hand knob 68 is attached to a hand knob shaft 70 which is retained within a removable hand knob shaft carriage 72 (best understood from FIG. 30). The hand knob shaft 70 is operatively attached to the rotatable threaded shaft 56 such that, when the hand knob 68 is rotated, the rotatable shaft 56 is also rotated. Thus, the rotation of the hand knob 68 causes the movement of the adjustment nut 54 along the rotatable shaft 56 so as to rotate the adjustment lever 50 about the torsion spring shaft 44. The hand knob shaft 70 has at least one gear 74 which cooperates with a large gear 75 disposed on the rotatable shaft 56 to provide increased mechanical advantage in the rotation of the hand knob 68.

As illustrated in FIGS. 11 and 13–18, both the chair seat 14 and the chair back 12 are attached to the torsion spring 38 such that the rearward tilting of both the back 12 and the seat 14 of the chair 16 is resisted by the tension of the torsion spring 38. In other embodiments, the adjustable torsion spring 38 can be attached only to the back 12, such that the rearward tilting of the back 12, but not the seat 14, is resisted by the tension of the torsion spring 38.

As illustrated in FIGS. 11–18, the torsion spring 38 is attached to the back 12 of the chair 16 by a pair of opposed connection members 76. The torsion spring 38 is connected to the seat 14 of the chair 16 via a pair of opposed seat attachment members 78. Both the pair of connection members 76 and the pair of seat attachment members 78 are affixed to the opposed ends 46 of the torsion spring shaft 44, such that the rotation of the connection members 76 and the rotation of the chair attachment members 78 are resisted by the torsion spring 38.

A suitable connection member 76 is illustrated in FIGS. 16–18. Each connection member 76 comprises a proximal portion 80 which is connected to one of the opposed ends 46 of the torsion spring shaft 44, a central portion 82 and a distal portion 84 which is connected to the back 12 of the chair 16. The connection members 76 can be made from a tubular metallic material. In one embodiment, the connection members 76 can be made from a fiberglass-filled nylon, such as from nylon 6 wherein the percentage of fiberglass within the nylon is between about 10% and about 35%. In embodiments wherein the connection members 76 are fiberglass-filled nylon, however, the proximal portions 80 of the connection members 76 are preferably made from a metal, such as from an aluminum.

In the embodiment illustrated in the drawings, each central portion 82 of each connection member 76 has a pair of opposed side surfaces 86 and an elongate cut-out 88 running between the pair of opposed side surfaces 86. In a typical embodiment, such as that which is illustrated in the drawings, each elongate cut-out 88 is between about 1" and about 4" long and between about ⅜" and about ½" wide. Such elongate cut-out 88 provides the central portion 82 of each connection member 76 with a certain degree of increased flexion about an axis of flexion 90 disposed within the elongate cut-out 88. This allows the back 12 to comfortably tilt rearwardly at an increased rate and to an increased distance relative to the rearward tilting of backs 12 supported by connection members 76 without cut-outs 88 and relative to the downward tilting of the seat 14.

Preferably, the end portions 92 of each cut-out 88 are rounded. Such rounded end portions 92 minimize the tendency of the connection members 76 to crack at the end portions 92 of the elongate cut-outs 88.

The aforementioned unique design of the connection members 76 with elongate cut-outs 88 is applicable not only to tilt back chairs, but to virtually all other kinds of seating devices, including non-tilt back chairs, benches, settees, etc.

In the embodiment illustrated in the drawings (most notably in FIGS. 20–28), the rearward side 94 of the back 12 is attached to the tilt assembly 28 via the pair of opposed connection members 76. In this embodiment, the distal portion 84 of the each connection member 76 has an elongate groove 95. The rearward side 94 of the back 12 has one or more matching elongate ridges 96 which are disposed within each of the elongate grooves 95. The cooperation of the elongate ridges 96 and the elongate grooves 95 firmly retains the back 12 to the one or more connection members 76. This unique method of connecting the back 12 to the pair of connection members 76 eliminates the need for a rivet, screw or other attachment pin from having to be disposed laterally into or completely through the back 12. Elimination of the use of an attachment pin disposed within or through the back 12 increases the aesthetic value of the back 12, decreases the tendency of the back 12 to crack at the requisite attachment pin insertion hole and minimizes the tendency of the head of the attachment pin to cause discomfort to the user or to catch on the user's clothing.

In the embodiment illustrated in the drawings, each elongate ridge 96 comprises a pair of spaced apart elongate ridge moieties 98 formed integral to the rearward side 94 of the back 12. Each elongate ridge 96 further comprises a stiffener member 100 attached to the elongate ridge moieties 98 to provides the elongate ridge moieties 98 with increased rigidity. Each such stiffener member 100 is typically non-integral to the back 12.

Also in the embodiment illustrated in the drawings, the elongate ridges 96 are further retained within the elongate grooves 95 by one or more attachment pins 102. Preferably, each such attachment pin 102 is a machine screw such as illustrated in the drawings. In other embodiments, a rivet or other type of attachment pin 102 can be used.

This unique method of attaching the back 12 of the chair 16 to the attachment elements 76 without the need of attachment pins disposed laterally into or completely through the back 12 of the chair 16 is not restricted to tilt back chairs. Such attachment method can also be applied in most other forms of seating devices, such as non-tilt back chairs, benches, settees, etc.

Finally, as illustrated in the drawings, the arm rests 20 of the chair 16 can be attached to the back 12 of the chair 16 and the pair of opposed connection members 76 using the attachment pins 102 which retain the elongate ridges 96 to the connection members 76.

Having thus described the invention, it should be apparent that numerous structural modifications and adaptations may be resorted to without departing from the scope and fair meaning of the instant invention as set forth hereinabove and as described hereinbelow by the claims.

What is claimed is:

1. A tilt rate adjustment mechanism useful in a tilt back chair having a base, a seat and a back, the back being rearwardly tiltable with respect to the base, and the tilt rate adjustment mechanism being useful in the adjustment of the amount of tension required to tilt the back of the tilt back chair relative to the base, the tilt rate adjustment mechanism comprising:

(a) an adjustable torsion spring mounted on a torsion spring shaft, the torsion spring being operatively attached to the back of the tilt back chair such that the rearward tilting of the back is resisted by the tension of the torsion spring, the torsion spring having an adjustment lever for adjusting the tension on the torsion spring, the adjustment lever having a proximal end and a distal end, the adjustment lever being rotatable about the torsion spring shaft between a minimum tension position wherein the torsion spring resists the tilting of the chair back with minimum tension and a maximum tension position wherein the torsion spring resists the tilting of the chair back with maximum tension;

(b) a tilt rate adjustment actuator disposed in contact with the adjustment lever such that the movement of the adjustment actuator causes movement of the adjustment lever, the adjustment actuator being movable between (i) a first actuator position wherein the actuator contacts the lever at a first location along the lever which is distal to the distal end of the lever and the adjustment lever is in the minimum tension position and (ii) a second actuator position wherein the actuator contacts the lever at a second location along the lever which is proximal to the distal end of the lever and the adjustment lever is in the maximum tension position; and (c) an actuator movement mechanism for alternatively moving the actuator back and forth between the first actuator position and the second actuator position.

2. The tilt rate adjustment mechanism of claim 1 wherein the adjustable torsion spring is an elastomeric torsion spring.

3. The tilt rate adjustment mechanism of claim 1 wherein the chair seat is downwardly tiltable with respect to the base and wherein the adjustable torsion spring is operatively attached to the back and the seat of the tilt back chair such that the downwardly tilting of the chair seat, as well as the rearward tilting of the chair back, is resisted by the tension of the torsion spring.

4. The tilt rate adjustment mechanism of claim 1 wherein the tilt rate adjustment actuator comprises an internally threaded tension adjustment nut and wherein the actuator movement mechanism comprises a rotatable threaded shaft having external threads which match the internal threads of the adjustment nut, the adjustment nut being mounted on the threaded shaft such that the rotation of the threaded shaft causes the lateral movement of the adjustment nut along the threaded shaft.

5. The tilt rate adjustment mechanism of claim 4 wherein the seat of the tilt back chair has a forward portion, a rearward portion, a pair of opposed side portions, a longitudinal axis disposed horizontally between the center of the forward portion and the center of the rearward portion and a transverse axis disposed horizontally between the centers of the opposed side portions, the torsion spring shaft being disposed substantially parallel with the transverse axis and the rotatable threaded shaft being disposed substantially parallel with the longitudinal axis.

6. The tilt rate adjustment mechanism of claim 5 wherein the movement of the adjustment nut in a direction from the forward portion of the seat to the rearward portion of the seat causes the adjustment lever of the adjustable torsion spring to rotate upwardly.

7. The tilt rate adjustment mechanism of claim 4 wherein the threaded shaft is rotated by a hand knob disposed beneath the seat.

8. The tilt rate adjustment mechanism of claim 7 wherein the hand knob is disposed upon a rotatable hand knob shaft which is operatively connected to the rotatable threaded shaft by at least one gear.

9. A tilt rate adjustment mechanism useful in a tilt back chair having a base, a seat and a back, the back being rearwardly tiltable with respect to the base, and the seat being downwardly tiltable with respect to the base, the tilt rate adjustment mechanism being useful in the adjustment of the amount of tension required to tilt the back of the tilt back and seat chair relative to the base, the tilt rate adjustment mechanism comprising:

(a) an adjustable elastomeric torsion spring mounted on a torsion spring shaft, the torsion spring being operatively attached to the back and seat of the tilt back chair such that the rearward tilting of the back and the downward tilting of the seat are resisted by the tension on the torsion spring, the torsion spring having an adjustment lever for adjusting the tension on the torsion spring, the adjustment lever having a proximal end and a distal end, the proximal end of the adjustment lever being rotatable about the torsion spring shaft between a minimum tension position wherein the torsion spring resists the tilting of the chair back and the chair seat with minimum tension and a maximum tension position wherein the torsion spring resists the tilting of the chair back and the chair seat with maximum tension;

(b) a tilt rate adjustment actuator disposed in contact with the adjustment lever such that the movement of the adjustment actuator causes movement of the adjustment lever, the adjustment actuator being movable between (i) a first actuator position wherein the actuator contacts the lever at a first location along the lever which is distal to the distal end of the lever and the adjustment lever is in the minimum tension position and (ii) a second actuator position wherein the actuator contacts the lever at a second location along the lever which is proximal to the distal end of the lever and the adjustment lever is in the maximum tension position; and (c) an actuator movement mechanism for alternatively moving the actuator back and forth between the first actuator position and the second actuator position.

10. The tilt rate adjustment mechanism of claim 9 wherein the tilt rate adjustment actuator comprises an internally threaded tension adjustment nut and wherein the actuator movement mechanism comprises a rotatable threaded shaft having external threads which match the internal threads of the adjustment nut, the adjustment nut being mounted on the threaded shaft such that the rotation of the threaded shaft causes the lateral movement of the adjustment nut along the threaded shaft.

11. The tilt rate adjustment mechanism of claim 10 wherein the seat of the tilt back chair has a forward portion, a rearward portion, a pair of opposed side portions, a longitudinal axis disposed horizontally between the center of the forward portion and the center of the rearward portion and a transverse axis disposed horizontally between the centers of the opposed side portions, the torsion spring shaft being disposed substantially parallel with the transverse axis and the rotatable threaded shaft being disposed substantially parallel with the longitudinal axis.

12. The tilt rate adjustment mechanism of claim 11 wherein the movement of the adjustment nut in a direction from the forward portion of the seat to the rearward portion of the seat causes the adjustment lever of the adjustable torsion spring to rotate upwardly.

13. The tilt rate adjustment mechanism of claim 10 wherein the threaded shaft is rotated by a hand knob disposed beneath the seat.

14. The tilt rate adjustment mechanism of claim 13 wherein the hand knob is disposed upon a rotatable hand knob shaft which is operatively connected to the rotatable threaded shaft by at least one gear.

15. A tilt back chair comprising:

(a) a seat for supporting a seated user;

(b) a base for supporting the seat above the floor;

(c) a chair back for supporting the back of a user seated upon the seat, the chair back being rearwardly tiltable with respect to the base; and (d) a tilt rate adjustment mechanism for adjusting the amount of tension required to tilt the chair back relative to the base, the tilt rate adjustment mechanism comprising:

(i) an adjustable torsion spring mounted on a torsion spring shaft, the torsion spring being operatively attached to the chair such that the rearward tilting of the chair back is resisted by the tension of the torsion spring, the torsion spring having an adjustment lever for adjusting the tension on the torsion spring, the adjustment lever having a proximal end and a distal end, the proximal end of the adjustment lever being rotatable about the torsion spring shaft between a minimum tension position wherein the torsion spring resists the tilting of the chair back with minimum tension and a maximum tension position wherein the torsion spring resists the tilting of the chair back with maximum tension;

(ii) a tilt rate adjustment actuator disposed in contact with the adjustment lever such that the movement of the adjustment actuator causes movement of the adjustment lever, the adjustment actuator being movable between (A) a first actuator position wherein the actuator contacts the lever at a first location along the lever which is distal to the distal end of the lever and the adjustment lever is in the minimum tension position and (B) a second actuator position wherein the actuator contacts the lever at a second location along the lever which is proximal to the distal end of the lever and the adjustment lever is in the maximum tension position; and (iii) an actuator movement mechanism for alternatively moving the actuator back and forth between the first actuator position and the second actuator position.

16. The tilt back chair of claim 15 wherein the adjustable torsion spring is an elastomeric torsion spring.

17. The tilt rate adjustment mechanism of claim 15 wherein the chair seat is downwardly tiltable with respect to the base and wherein the adjustable torsion spring is operatively attached to the back and the seat of the tilt back chair such that the downwardly tilting of the chair seat, as well as the rearward tilting of the chair back, is resisted by the tension of the torsion spring.

18. The tilt back chair of claim 15 wherein the tilt rate adjustment actuator comprises an internally threaded tension adjustment nut and wherein the actuator movement mechanism comprises a rotatable threaded shaft having external threads which match the internal threads of the adjustment nut, the adjustment nut being mounted on the threaded shaft such that the rotation of the threaded shaft causes the lateral movement of the adjustment nut along the threaded shaft.

19. The tilt back chair of claim 18 wherein the seat of the tilt back chair has a forward portion, a rearward portion, a pair of opposed side portions, a longitudinal axis disposed horizontally between the center of the forward portion and the center of the rearward portion and a transverse axis disposed horizontally between the centers of the opposed side portions, the torsion spring shaft being disposed substantially parallel with the transverse axis and the rotatable threaded shaft being disposed substantially parallel with the longitudinal axis.

20. The tilt rate back chair of claim 19 wherein the movement of the adjustment nut in a direction from the forward portion of the seat to the rearward portion of the seat causes the adjustment lever of the adjustable torsion spring to rotate upwardly.

21. The tilt back chair of claim 18 wherein the threaded shaft is rotated by a hand knob disposed beneath the seat.

22. The tilt back chair of claim 21 wherein the hand knob is disposed upon a rotatable hand knob shaft which is operatively connected to the rotatable threaded shaft by at least one gear.

23. The tilt back chair of claim 15 wherein the back comprises a forward side and a rearward side and the rearward side is attached to the seat via one or more connection members, the one or more connection members having an upper end and a lower end, each of the upper ends of the connection members having an elongate groove, the rearward side of the back having one or more matching elongate ridges disposed within each of the elongate grooves such that the cooperation of the elongate ridges and the elongate grooves firmly retains the back to the one or more connection members, whereby the back is attached to the connection members without the use of an attachment pin disposed laterally into or completely through the back.

24. The seating device of claim 23 further comprising one or more attachment pins for firmly retaining each of the elongate ridges to the upper ends of the one or more connection members.

25. The seating device of claim 23 wherein each elongate ridge comprises:

(a) a pair of spaced apart elongate ridge moieties integral to the rearward side of the back; and (b) a stiffener member attached to the elongate ridge moieties to provide the elongate ridge moieties with increased rigidity, the stiffener member being non-integral to the back.

26. The tilt back chair of claim 15 wherein the back is attached to the seat via one or more elongate connection members, each of the one or more elongate connection members having a pair of opposed side surfaces and an elongate cut-out running between the pair of opposed side surfaces, such that the back is capable of additional rearwardly tilting with respect to the base about an axis of flexion disposed within the elongate cut-out.

27. The seating device of claim 26 wherein the elongate cut-out has rounded end portions.

28. A tilt back chair comprising:

(a) a seat for supporting a seated user, the seat being downwardly tiltable with respect to the base;

(b) a base for supporting the seat above the floor;

(c) a chair back for supporting the back of a user seated upon the seat, the chair back being rearwardly tiltable with respect to the base; and (d) a tilt rate adjustment mechanism for adjusting the amount of tension required to tilt the chair back and seat relative to the base, the tilt rate adjustment mechanism comprising:

(i) an adjustable elastomeric torsion spring mounted on a torsion spring shaft, the torsion spring being operatively attached to the chair such that the rearward tilting of the chair back and the downward tilting of the seat is resisted by the tension of the torsion spring, the torsion spring having an adjustment lever for adjusting the tension on the torsion spring, the adjustment lever having a proximal end and a distal end, the proximal end of the adjustment lever being rotatable about the torsion spring shaft between a minimum tension position wherein the torsion spring resists the tilting of the chair back and chair seat with minimum tension and a maximum tension position wherein the torsion spring resists the tilting of the chair back and the chair seat with maximum tension;

(ii) a tilt rate adjustment actuator disposed in contact with the adjustment lever such that the movement of the adjustment actuator causes movement of the adjustment lever, the adjustment actuator being movable between (A) a first actuator position wherein the actuator contacts the lever at a first location along the lever which is distal to the distal end of the lever and the adjustment lever is in the minimum tension position and (B) a second actuator position wherein the actuator contacts the lever at a second location along the lever which is proximal to the distal end of the lever and the adjustment lever is in the maximum tension position; and (iii) an actuator movement mechanism for alternatively moving the actuator back and forth between the first actuator position and the second actuator position.

29. The tilt back chair of claim 28 wherein the tilt rate adjustment actuator comprises an internally threaded tension adjustment nut and wherein the actuator movement mechanism comprises a rotatable threaded shaft having external threads which match the internal threads of the adjustment nut, the adjustment nut being mounted on the threaded shaft such that the rotation of the threaded shaft causes the lateral movement of the adjustment nut along the threaded shaft.

30. The tilt back chair of claim 29 wherein the seat of the tilt back chair has a forward portion, a rearward portion, a pair of opposed side portions, a longitudinal axis disposed horizontally between the center of the forward portion and the center of the rearward portion and a transverse axis disposed horizontally between the centers of the opposed side portions, the torsion spring shaft being disposed substantially parallel with the transverse axis and the rotatable threaded shaft being disposed substantially parallel with the longitudinal axis.

31. The tilt rate back chair of claim 30 wherein the movement of the adjustment nut in a direction from the forward portion of the seat to the rearward portion of the seat causes the adjustment lever of the adjustable torsion spring to rotate upwardly.

32. The tilt back chair of claim 29 wherein the threaded shaft is rotated by a hand knob disposed beneath the seat.

33. The tilt back chair of claim 32 wherein the hand knob is disposed upon a rotatable hand knob shaft which is operatively connected to the rotatable threaded shaft by at least one gear.

34. The tilt back chair of claim 28 wherein the back comprises a forward side and a rearward side and the rearward side is attached to the seat via one or more connection members, each of the connection members having an upper end and a lower end, each of the upper ends of the connection members having an elongate groove, the rearward side of the back having one or more matching elongate ridges disposed within each of the elongate grooves such that the cooperation of the elongate ridges and the elongate grooves firmly retains the back to the one or more connection members, whereby the back is attached to the connection members without the use of an attachment pin disposed laterally into or completely through the back.

35. The tilt back chair of claim 34 further comprising one or more attachment pins for firmly retaining each of the elongate ridges to the upper ends of the one or more connection members.

36. The tilt back chair of claim 35 wherein each elongate ridge comprises:

(a) a pair of spaced apart elongate ridge moieties integral to the rearward side of the back; and (b) a stiffener member attached to the elongate ridge moieties to provide the elongate ridge moieties with increased rigidity, the stiffener member being non-integral to the back.

37. The tilt back chair of claim 28 wherein the back is attached to the seat via one or more elongate connection members, each of the one or more elongate connection members having a pair of opposed side surfaces and an elongate cut-out running between the pair of opposed side surfaces, such that the back is capable of additional rearwardly tilting with respect to the base about an axis of flexion disposed within the elongate cut-out.

38. The tilt back chair of claim 37 wherein the elongate cut-out has rounded end portions.

39. A seating device having a lower portion and a back, the lower portion comprising a seat and a base, the back comprising a forward side and a rearward side, the rearward side of the back being attached to the lower portion of the chair via one or more connection members each having an upper end and a lower end, wherein each of the upper ends of the connection members has an elongate groove and wherein the rearward side of the back has one or more matching elongate ridges disposed within each of the elongate grooves such that the cooperation of the elongate ridges and the elongate grooves firmly retains the back to the one or more connection members, whereby the back is attached to the connection members without the use of an attachment pin disposed laterally into or completely through the back.

40. A seating device having a lower portion and a back, the lower portion comprising a seat and a base, the back being attached to the lower portion via one or more elongate connection members, wherein each of the one or more elongate connection members has a pair of opposed side surfaces and an elongate cut-out running between the pair of opposed side surfaces, such that the back is capable of rearwardly tilting with respect to the base about an axis of flexion disposed within the elongate cut-out.

41. The seating device of claim 40 wherein the elongate cut-out has rounded end portions.

42. A tilt rate adjustment mechanism useful in a tilt back chair having a base, a seat and a back, the back being rearwardly tiltable with respect to the base, and the seat being downwardly tiltable with respect to the base, the tilt rate adjustment mechanism being useful in the adjustment of the amount of tension required to tilt the seat of the tilt back chair relative to the base, the tilt rate adjustment mechanism comprising:

(a) an adjustable torsion spring mounted on a torsion spring shaft, the torsion spring being operatively attached to the seat of the tilt back chair such that the downward tilting of the seat is resisted by the tension of the torsion spring, the torsion spring having an adjustment lever for adjusting the tension on the torsion spring, the adjustment lever having a proximal end and a distal end, the adjustment lever being rotatable about the torsion spring shaft between a minimum tension position wherein the torsion spring resists the tilting of the chair seat with minimum tension and a maximum tension position wherein the torsion spring resists the tilting of the chair seat with maximum tension;

(b) a tilt rate adjustment actuator disposed in contact with the adjustment lever such that the movement of the adjustment actuator causes movement of the adjustment lever, the adjustment actuator being movable between (i) a first actuator position wherein the actuator contacts the lever at a first location along the lever which is distal to the distal end of the lever and the adjustment lever is in the minimum tension position and (ii) a second actuator position wherein the actuator contacts the lever at a second location along the lever which is proximal to the distal end of the lever and the adjustment lever is in the maximum tension position; and (c) an actuator movement mechanism for alternatively moving the actuator back and forth between the first actuator position and the second actuator position.

43. The tilt rate adjustment mechanism of claim 42 wherein the adjustable torsion spring is an elastomeric torsion spring.

44. The tilt rate adjustment mechanism of claim 42 wherein the tilt rate adjustment actuator comprises an internally threaded tension adjustment nut and wherein the actuator movement mechanism comprises a rotatable threaded shaft having external threads which match the internal threads of the adjustment nut, the adjustment nut being mounted on the threaded shaft such that the rotation of the threaded shaft causes the lateral movement of the adjustment nut along the threaded shaft.

45. The tilt rate adjustment mechanism of claim 44 wherein the seat of the tilt back chair has a forward portion, a rearward portion, a pair of opposed side portions, a longitudinal axis disposed horizontally between the center of the forward portion and the center of the rearward portion and a transverse axis disposed horizontally between the centers of the opposed side portions, the torsion spring shaft being disposed substantially parallel with the transverse axis and the rotatable threaded shaft being disposed substantially parallel with the longitudinal axis.

46. The tilt rate adjustment mechanism of claim 45 wherein the movement of the adjustment nut in a direction from the forward portion of the seat to the rearward portion of the seat causes the adjustment lever of the adjustable torsion spring to rotate upwardly.

47. The tilt rate adjustment mechanism of claim 44 wherein the threaded shaft is rotated by a hand knob disposed beneath the seat.

48. The tilt rate adjustment mechanism of claim 47 wherein the hand knob is disposed upon a rotatable hand knob shaft which is operatively connected to the rotatable threaded shaft by at least one gear.

49. The seating device of claim 39 further comprising one or more attachment pins for firmly retaining each of the elongate ridges to the upper ends of the one or more connection members.

50. The seating device of claim 39 wherein each elongate ridge comprises:

(a) a pair of spaced apart elongate ridge moieties integral to the rearward side of the back; and (b) a stiffener member attached to the elongate ridge moieties to provide the elongate ridge moieties with increased rigidity, the stiffener member being non-integral to the back.

* * * * *